US009638206B2

(12) United States Patent
van den Berg et al.

(10) Patent No.: US 9,638,206 B2
(45) Date of Patent: May 2, 2017

(54) CENTRIFUGAL PUMP AND A DOUBLE BENT ROTOR BLADE FOR USE IN SUCH A CENTRIFUGAL PUMP

(75) Inventors: Cornelis Hendrik van den Berg, Sliedrecht (NL); Hasan Hüseyin Bugdayci, Barendrecht (NL); Erwin Cornelis Johannes Bijvoet, Zevenbergen (NL); Mattheus Abraham Manneke, Breda (NL)

(73) Assignee: IHC Holland IE B.V., Sliedrecht (NL)

( * ) Notice: Subject to any disclaimer, the term of this patent is extended or adjusted under 35 U.S.C. 154(b) by 958 days.

(21) Appl. No.: 13/991,390

(22) PCT Filed: Dec. 1, 2011

(86) PCT No.: PCT/NL2011/050827

§ 371 (c)(1),
(2), (4) Date: Aug. 26, 2013

(87) PCT Pub. No.: WO2012/074402

PCT Pub. Date: Jun. 7, 2012

(65) Prior Publication Data

US 2013/0336774 A1 Dec. 19, 2013

(30) Foreign Application Priority Data

Dec. 3, 2010 (NL) ..... 2005810

(51) Int. Cl.
*F04D 29/54* (2006.01)
*F04D 29/22* (2006.01)
(Continued)

(52) U.S. Cl.
CPC ..... *F04D 29/22* (2013.01); *F04D 7/04* (2013.01); *F04D 29/24* (2013.01)

(58) Field of Classification Search
CPC ..... F04D 29/22; F04D 29/24; F04D 7/04
(Continued)

(56) References Cited

U.S. PATENT DOCUMENTS 3,964,840 A 6/1976 Kamelmacher

FOREIGN PATENT DOCUMENTS

DE 101 49 648 A1 5/2002
EP 1 903 216 A1 3/2008
(Continued)

OTHER PUBLICATIONS

International Preliminary Report on Patentability for International Application No. PCT/NL2011/050827.
(Continued)

*Primary Examiner* — Jesse Bogue
*Assistant Examiner* — Kelsey Stanek
(74) *Attorney, Agent, or Firm* — NLO N.V.; Catherine A. Shultz; Minerva Rivero

(57) ABSTRACT

The invention relates to a centrifugal pump (1) comprising a pump housing (2) which is provided with an axial inlet (6), an outlet (5) and a rotor (7) which is attached in the pump housing (2) such that it can rotate about an axial rotation axis A. The rotor (7) is provided with a central boss (9), a shaft shield (11) fastened to the boss (9), a suction shield (12) attached so as to be axially set apart from the shaft shield (11), which suction shield (12) has an axial supply (14) aligned with the axial inlet (6) of the pump housing (2), and a plurality of rotor blades (15) which are fastened between the shields (11, 12). The radial inner ends (18) of the rotor blades (15) are connected to the suction shield (12) by a substantial perpendicular connection.

13 Claims, 9 Drawing Sheets

(51) Int. Cl.
*F04D 7/04* (2006.01)
*F04D 29/24* (2006.01)

(58) Field of Classification Search
USPC ..... 415/204, 206; 416/242
See application file for complete search history.

(56) References Cited

FOREIGN PATENT DOCUMENTS

| | | | | |
|---|---|---|---|---|
| EP | 2 236 836 | A2 | 10/2010 | |
| JP | 8-284885 | A | 10/1996 | |
| JP | EP 2236836 | A2 * | 10/2010 | ..... B29C 65/08 |

OTHER PUBLICATIONS

International Search Report for International Application No. PCT/NL2011/050827.

* cited by examiner

CENTRIFUGAL PUMP AND A DOUBLE BENT ROTOR BLADE FOR USE IN SUCH A CENTRIFUGAL PUMP

CROSS-REFERENCE TO RELATED APPLICATIONS

This application is the National Stage of International Application No. PCT/NL2011/050827, filed Dec. 1, 2011, which claims the benefit of Netherlands Application No. 2005810, filed Dec. 3, 2010, the entire contents of all of which are incorporated by reference herein.

TECHNICAL FIELD

The invention relates to a centrifugal pump, in particular for the pumping of a mixture of substances possibly including soil, comprising:

a pump housing which is provided with an axial inlet and an outlet attached tangentially to a circumferential wall of the pump housing, a rotor which is attached in the pump housing such that it can rotate about an axial rotation axis A, which rotor is provided with a central boss, a shaft shield fastened to the boss, a suction shield attached so as to be axially set apart from the shaft shield, which suction shield has an axial supply aligned with the axial inlet of the pump housing, and a plurality of double bent rotor blades which are fastened between the shields and each extend substantially transversely to the rotation axis A between a radial outer end and a radial inner end. The invention further relates to a double bent rotor blade for use in such a centrifugal pump and a vessel, comprising such a centrifugal pump.

BACKGROUND

Centrifugal pumps are known. Two types of pumps can de distinguished: pumps with single bent rotor blades, such as shown in EP2236836A2 and JP 8 284 885, and pumps with double bent rotor blades. Examples thereof are known from European patent application EP 1 903 216 A1 and EP1906029. This document relates to problems and solutions thereof associated with double bent rotor blades.

An example of such a centrifugal pump with double bent rotor blades is depicted in FIGS. 1 and 2.

FIGS. 1 and 2 schematically depict a centrifugal pump 1, comprising a pump housing 2 shaped like a volute (spiral casing). The pump housing 2 has a circumferential wall 3 and a spout-shaped outlet 5 attached tangentially to the circumferential wall 3 of the pump housing 2. The junction between the inner surface of the tangential outlet 5 and the inner surface of the circumferential wall 3 of the pump housing 2 defines what is known as a cutwater 4. The pump housing 2 also has an axial inlet 6.

A rotor 7 is attached in the pump housing 2 such that it may rotate about an axial rotation axis A. The rotor 7 has a central boss 9 which may be fastened to a drive shaft (not shown). A shaft shield 11 extends from the central boss 9. The shaft shield 11 forms a first wall for delimiting the flow within the rotor 7. Axially set apart from the shaft shield 11, the rotor has a suction shield 12 which defines a second wall for delimiting the flow within the rotor 7. The suction shield 12 has an axial supply 14 which is aligned with the axial inlet of the pump housing 2.

A plurality (three in FIGS. 1 and 2) of rotor blades 15 are fastened between the shields 11, 12. In this illustrative embodiment, the rotor 7 comprises three rotor blades 15. The rotor blades 15 each extend substantially radial to the rotation axis A. Each rotor blade 15 comprises a radial inner end 18 (leading edge) and a radial outer end 17 (trailing edge). The radial outer ends 17 and radial inner ends 18 run from the shaft shield 11 to the suction shield. Between the radial outer ends 17 of the rotor 7 and the inner surface of the circumferential wall 3 of the pump housing 2 there is a circumferential channel 19. The circumferential channel 19 has a passage surface area which increases somewhat in the circumferential direction from the cutwater 4 toward the outlet 5.

The characteristic dimensions of the centrifugal pump 1 are indicated in FIGS. 1 and 2. These characteristic dimensions largely determine the characteristics of the pump. The rotor 7 has an outermost diameter Dw which is defined by the radial outer edges of the shields 11, 12. The rotor 7 has a width Bw extending between the mutually facing surfaces of the shaft shield 11 and the suction shield 12. The axial supply 14 of the rotor 7 defines a suction diameter Dz. An inlet pipe can be connected to the axial inlet 6 of the pump housing 2. The centrifugal pump 1 also has what is known as a spherical passage Bol which is defined by the diameter of the largest sphere able to pass between the rotor blades (indicated in FIG. 1).

The rotor blades 15 are double bent rotor blades, which means that the rotor blade is curved in a first direction from the radial inner end 18 (leading edge) to the radial outer end 17 (trailing edge) and is curved in a second direction perpendicular to the first direction. Also indicated in FIG. 1 is a throat diameter Dk which is defined by the narrowest passage of the spout-shaped outlet 5 of the pump housing 2. Said narrowest passage is located in proximity to the cutwater 4. The spout-shaped outlet 5 also has a press diameter Dp located at the tip thereof. The distance, extending parallel to the centre line B of the outlet 5, between the crossing 4 and the level of the rotation axis A is indicated by the parameter T. The thickness of the circumferential channel 19 at the location of the cutwater 4 is represented in FIG. 1 by V.

During operation, the rotor rotates about the rotation axis A. Between the rotor blades 15, the mass to be pumped is forced radially outward into the pump housing 2 under the influence of centrifugal forces. Said mass is then entrained in the circumferential direction of the pump housing 2 toward the tangential outlet spout 5 of the pump housing 2. The pumped mass which, after leaving the rotor 7, is entrained in the circumferential direction of the pump housing 2 flows largely out of the tangential outlet of the pump housing 2. A small amount of the entrained mass recirculates, i.e. flows along the cutwater back into the pump housing 2.

FIG. 3 shows a perspective view of an example of the rotor 7 described above with reference to FIGS. 1 and 2.

Said centrifugal pump 1 can be used in dredging operations. If the centrifugal pump 1 is located on board a dredging ship, such as a cutter suction dredger or hopper suction dredger the centrifugal pump 1 has to fetch a loose mixture of substances, possibly including soil, stones and/or pebbles, from the sea floor. The main characteristics of a centrifugal pump used in dredging operations are 1) suction capacity, 2) durability and 3) spherical passage Bol (see FIG. 1). In use, the mixture of substances, possibly including stones and/or pebbles, flows through the centrifugal pump 1. In order to prevent blockage, said stones and/or pebbles have to be able to pass through the centrifugal pump 1 (Bol). A wide centrifugal pump 1 having few blades is suitable for this purpose. However, by widening the centrifugal pump 1 and reducing the number of rotor blades 15, the suction characteristics and durability of the centrifugal pump 1 are adversely affected.

DE 101 49 648 A1 describes an example of a pump with double bent rotor blades. This pump is of a different design than the pumps described above, i.e. the leading edge does not run from the shaft shield to the suction shield, but originates at a central shaft and does not end at the suction shield. Another centrifugal pump is shown in JP 8 284 885 A.

An object of the invention is to provide an improved centrifugal pump, which combines a relatively high suction capacity, with an improved durability and spherical passage.

SUMMARY OF THE INVENTION

According to the invention, this object is achieved in a centrifugal pump, in particular for the pumping of a mixture of substances possibly including soil, comprising:

- a pump housing which is provided with an axial inlet and an outlet attached tangentially to a circumferential wall of the pump housing,
- a rotor which is attached in the pump housing such that it can rotate about an axial rotation axis, which rotor is provided with a central boss, a shaft shield fastened to the boss, a suction shield attached so as to be axially set apart from the shaft shield, which suction shield has an axial supply aligned with the axial inlet of the pump housing, and a plurality of double bent rotor blades which are fastened between the shields and each extend substantially transversely to the rotation axis A between a radial outer end and a radial inner end, wherein the radial inner ends form a substantially right angle with respect to the suction shield.

The radial inner ends end at the suction shield with a substantial perpendicular connection. By providing a substantial perpendicular connection between the radial inner ends 18 to the suction shield 12, less material is needed thereby increasing the inflow area of the centrifugal pump 1.

According to a further aspect there is provided a double bent rotor blade for use in a centrifugal pump, in particular for the pumping of a mixture of substances possibly including soil, the rotor blade comprising a radial inner end and a radial outer end, the rotor blade being arranged to be mounted on a mounting position between a shaft shield and a suction shield in a centrifugal pump, the radial inner end being formed such that in the mounting position it forms a substantially right angle with respect to the suction shield.

According to a further aspect there is provided a vessel, comprising a centrifugal pump as provided above.

BRIEF DESCRIPTION OF THE DRAWINGS

The invention will now be described in greater detail with reference to an illustrative embodiment represented in the drawings, in which.

DETAILED DESCRIPTION OF THE INVENTION

Figure 1:
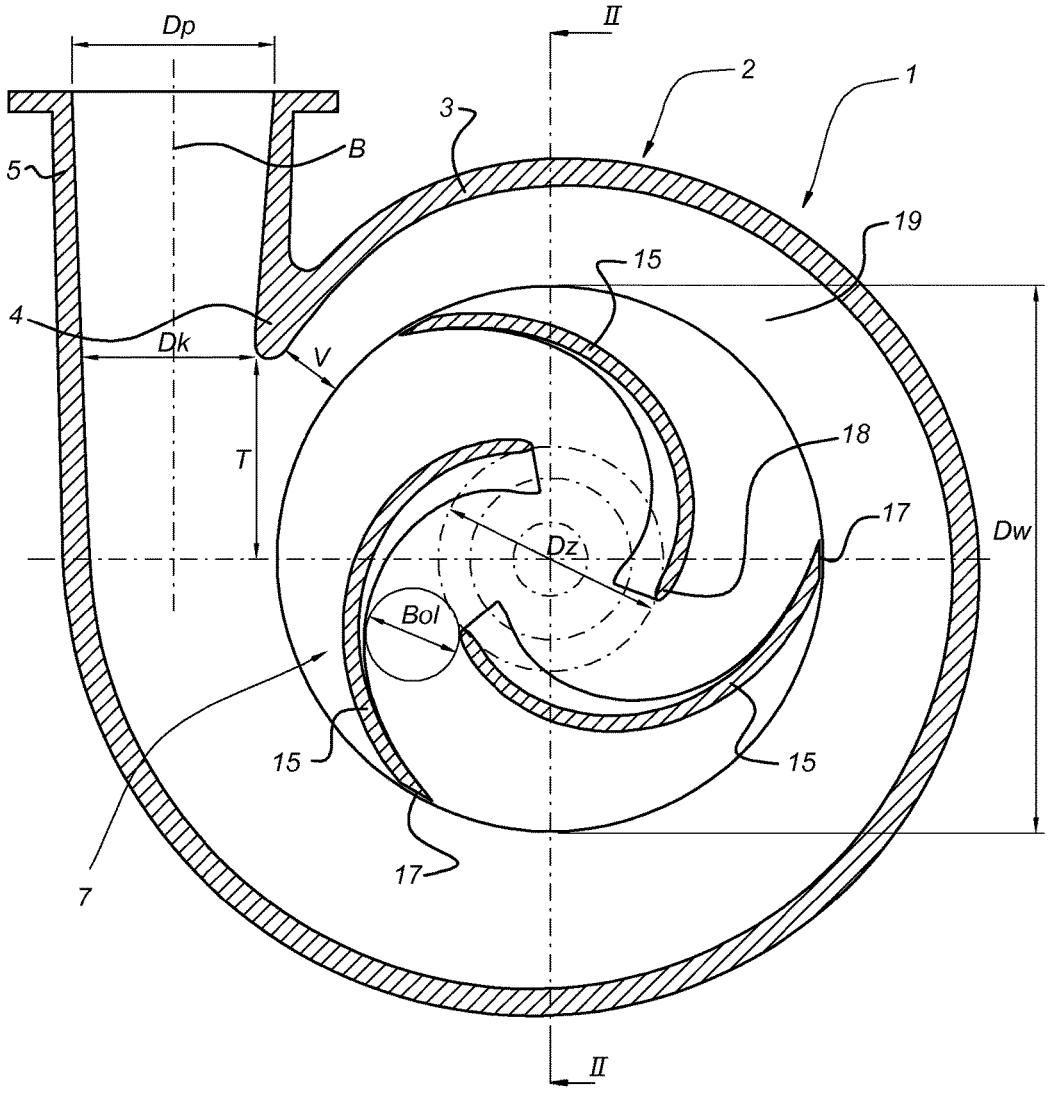
Fig 1 Prior Art
FIG. 1 is a front view in cross section of a centrifugal pump according to the prior art.
Figure 2:
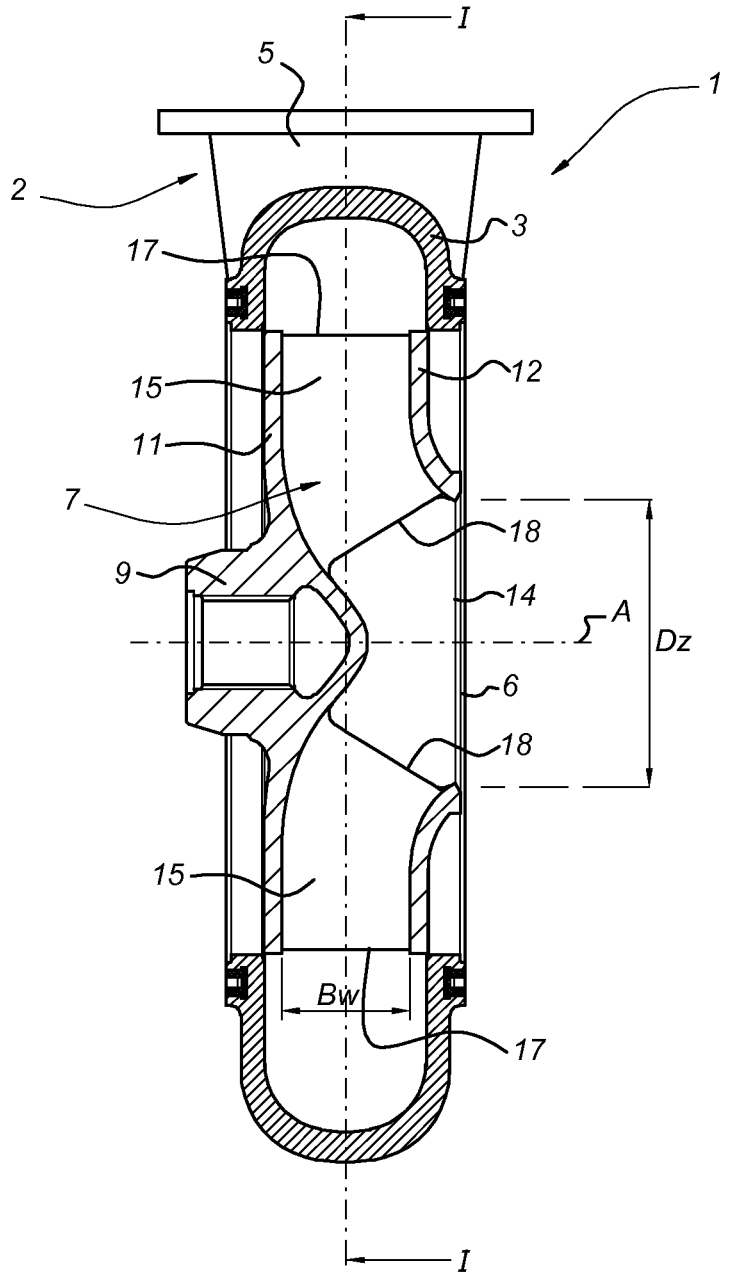
Fig 2 Prior Art
FIG. 2 is a side view in cross section along the line II-II in FIG. 1.
Figure 3:
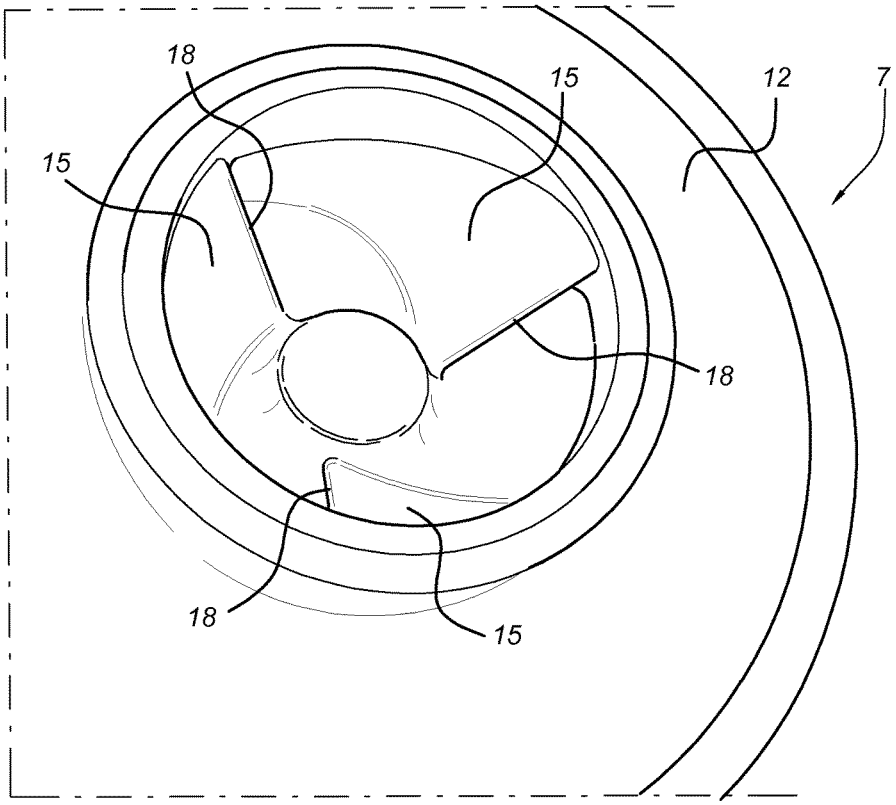
Fig 3 Prior Art
FIG. 3 is a perspective view of the rotor shown in FIGS. 1 and 2.

As explained above with reference to FIGS. 1-3, the rotor 7 is provided in the pump housing 2 in which it is rotatable suspended. In use, mass enters the pump housing 2 which is transported to the outlet 5 by the rotor 7. In the Figures, the outlet 5 is depicted as a spout-shaped outlet 5, but it will be understood that the outlet may also be provided with another suitable shape, such as a straight outlet 5.

The embodiments depicted in the Figures show a rotor comprising three rotor blades 15. The rotor blades 15 according to all embodiments are double bent rotor blades, which means that the rotor blade is curved in a first direction from the radial inner end 18 (leading edge) to the radial outer end 17 (trailing edge) and is curved in a second direction perpendicular to the first direction.

The radial outer ends 17 and radial inner ends 18 run from the shaft shield 11 to the suction shield 12.

It will be understood that any suitable number of rotor blades 15 may be provided, such as for instance four or five rotor blades 15. Each rotor blade 15 comprises a radial inner edge, also known as the leading edge and a radial outer edge, also known as the trailing edge. The trailing edge may be straight, possibly slanted.

Figure 4A:
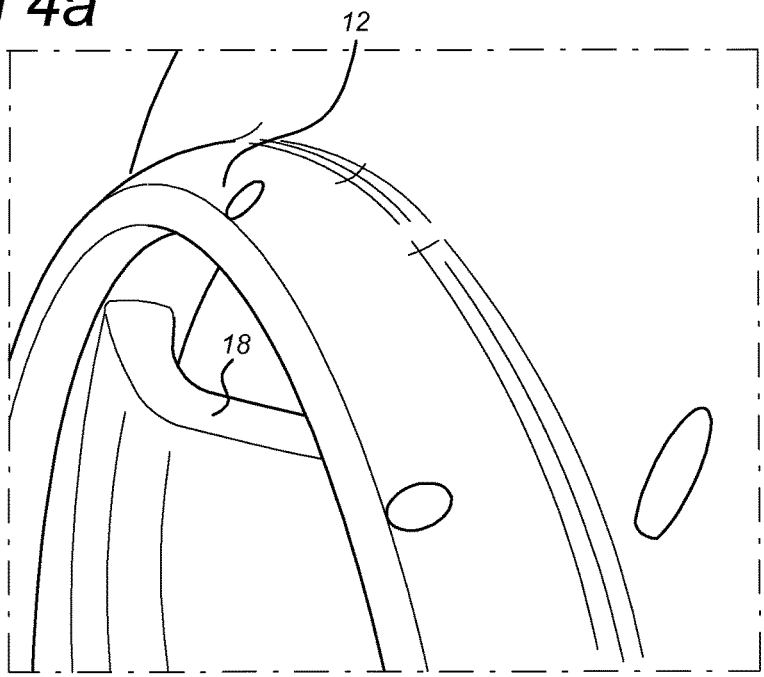
FIGS. 4*a* and 4*b* schematically show an embodiment of a centrifugal pump, FIG. 4*c* schematically shows an example from the prior art, FIGS. 5*a* and 5*b* schematically show a further embodiment, FIGS. 6*a-b*, 7*a-b* and 8 schematically show further embodiments of a centrifugal pump, FIGS. 9*a* and 9*b* schematically show a cross section of part of a centrifugal pump according to further embodiments.
Figure 4B:
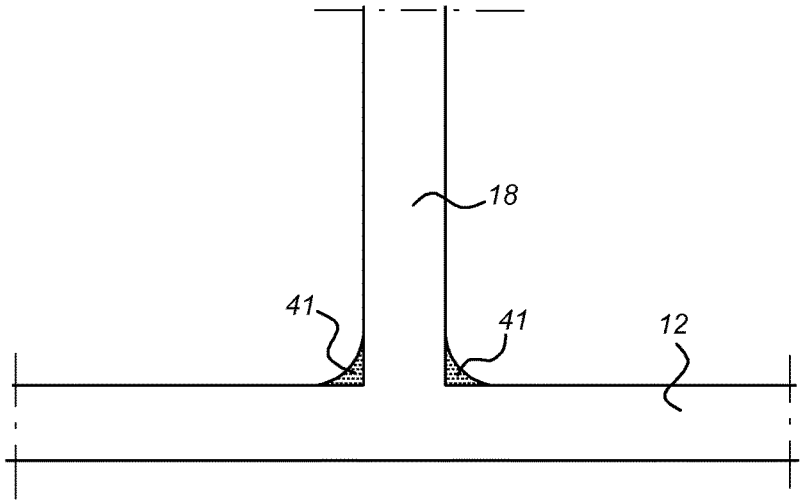

FIGS. 4*a*-4*b* schematically depicts a centrifugal pump 1 as described above with reference to FIGS. 1-3, wherein the radial inner ends 18 of the rotor blades 15 are connected to the suction shield 12 by a substantial perpendicular connection. The radial inner ends 18 form a substantially right angle with respect to the suction shield 12. In other words, the radial inner ends 18 are connected to the suction shield 12 in a substantial perpendicular way.

As shown in FIG. 4*a*, the end part of the radial inner end 18 that is connected to the suction shield 12 is directed in a radial direction away from the rotation axis A.

The suction shield 12 comprises a bent near an inner edge of the suction shield 12 defining a nozzle projecting in a direction towards the supply the mass to be pumped. The nozzle forms the axial supply 14. The nozzle comprises an inner wall to which the radial inner end 18 is connected. The radial inner end 18 is provided with a bent to provide a perpendicular connection between the radial inner end 18 and the inner edge of the suction shield 12.

In the technical field of centrifugal pumps for dredging, angles in the range of 85°-95°, or at least angle in the range of 88°-92°, will considered to be substantial perpendicular.

By providing a substantial perpendicular connection between the radial inner ends 18 to the suction shield 12, less material is needed thereby increasing the inflow area of the centrifugal pump 1.

FIG. 4*b* shows in more detail the connection between the radial inner end 18 and the suction shield 12. As can be seen in FIG. 4*b*, due to the casting process, casting curvatures 41 are formed in the corners.

Figure 4C:
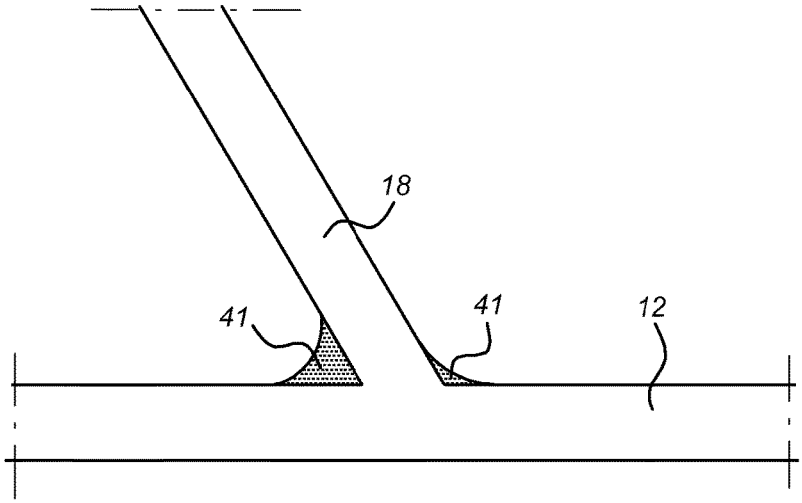
Fig 4c Prior Art

FIG. 4*c* shows a connection according to the prior art, wherein the angle between the radial inner end 18 to the suction shield was sharp, e.g. 60°. As can be seen by comparing FIGS. 4*b* and 4*c*, the casting curvatures 41 are relatively small when providing a substantial perpendicular connection. This results in a larger inflow area and an increased suction capacity of the centrifugal pump 1. Also, in case the same amount of mass is being pumped by a centrifugal pump 1 according to this embodiment, the flow velocity of the mass in the pump can be smaller, thereby reducing the wear and enhancing the decisive vacuum and the net positive suction head required.

Accordingly, according to an embodiment there is provided a double bent rotor blade 15 for use in a centrifugal pump 1, in particular for the pumping of a mixture of substances possibly including soil, the rotor blade 15 comprising a radial inner end 18 and a radial outer end 17, the rotor blade 15 being arranged to be mounted on a mounting position between a shaft shield 11 and a suction shield 12 in a centrifugal pump, the radial inner end 18 being formed such that in the mounting position it forms a substantially right angle with respect to the suction shield 12.

Figure 5A:
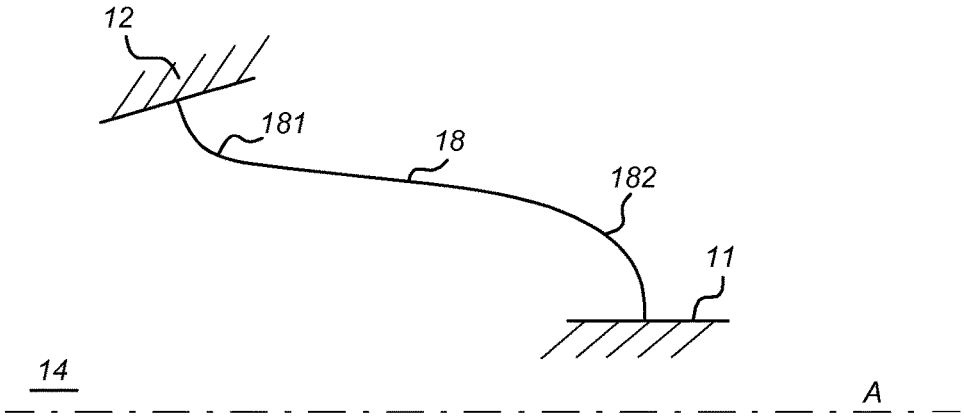
Figure 5B:
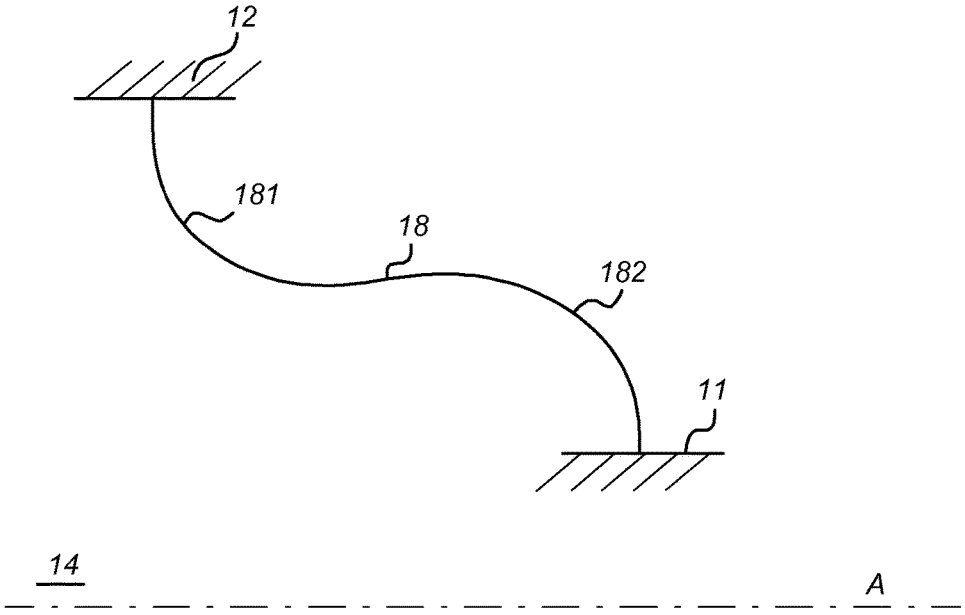

A further embodiment is depicted in FIGS. 5*a* and 5*b*. According to this embodiment there is provided a centrifugal pump 1, wherein the radial inner ends 18 of the rotor blades 15 extending between the shaft shield 11 and the suction shield 12 have a substantially S-curved shape comprising a first part 181 near the suction shield 12 being convex towards the axial supply 14 and a second part near the shaft shield 11 being concave towards the axial supply 14. Accordingly, also provided is a double bent rotor blade 15, wherein the radial inner end 18 has a substantially S-curved shape, which comprises a first part 181 which in the mounting position is near the suction shield 12, the first part 181 being convex with respect to an axial supply 14 of the centrifugal pump and a second part which after mounting is near the shaft shield 11, the second part 182 being concave with respect to the axial supply 14.

Instead of providing substantial straight radial inner ends, the radial inner ends 18 are substantially S-shaped, wherein the first part 181 is curved in a first direction and the second part 182 is curved in a second direction, opposite to the first direction.

The radial inner ends 18 may comprise further parts that are substantially uncurved, an example of which is schematically depicted in FIG. 5*a*. According to FIG. 5*a* a straight part is provided in between the first part 181 and the second part 182.

FIG. 5*b* depicts an embodiment in which the curved first part 181 and curved second part 182 are directly connected to each other.

As can be seen, the S-shaped radial inner ends 18 allow for an easy substantial perpendicular connection of the radial inner ends 18 to the suction shield 12.

The shape of the rotor blades 15 in a direction running from the radial inner ends 18 to the radial outer ends 17 determines the energy transfer from the rotor blades 15 to the mass being pumped. Different parts of the rotor blade 15 may be provided with different curvatures which transfer different amounts of energy to the mass being pumped.

Figure 6A:
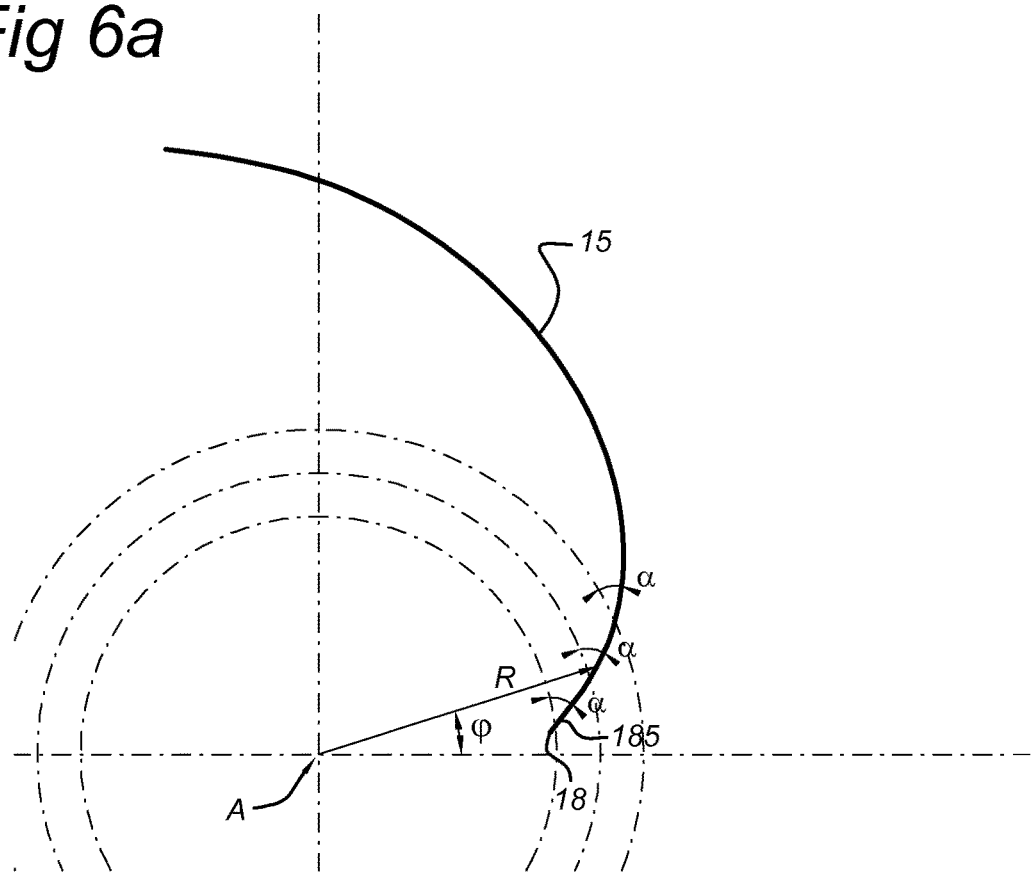
Figure 6B:
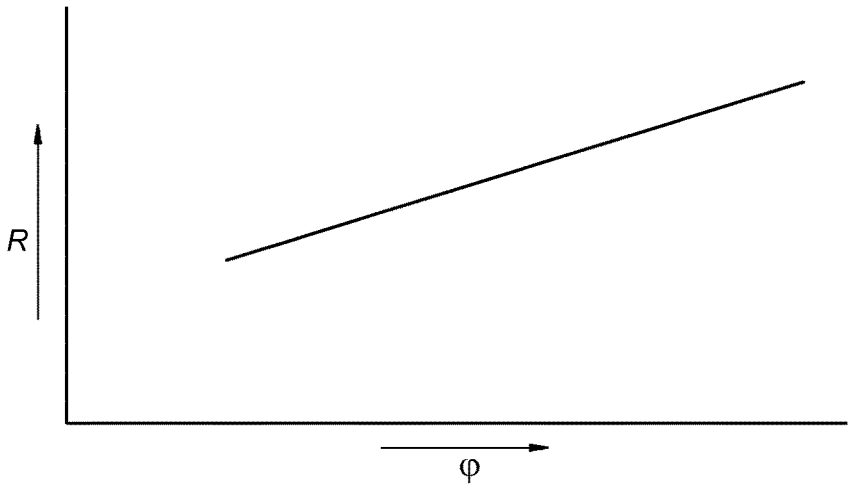

According to an embodiment there is provided a centrifugal pump 1, wherein the rotor blades 15 comprise a strip 185 along the radial inner ends 18 that is shaped such that in a direction perpendicular to the respective radial inner end 18 the radius R of the rotor blade 15 is a function of an angle $\phi$ with respect to the rotation axis A: $R(\phi)=C_1\cdot\phi+C_2$, wherein $C_1$ and $C_2$ are constants. Accordingly there is provided a rotor blade that is shaped as such. This embodiment is schematically depicted in FIG. 6*a*. An example $R(\phi)$ is schematically shown in FIG. 6*b*.

Angle $\phi$ is indicated in FIG. 6*a* and is defined in a plane substantially perpendicular with respect to the rotation axis A (perpendicular to the plane of drawing in FIG. 6*a*). Radius R and angle $\phi$ together thus form polar coordinates, with respect to the rotation axis A. For strip 185 applies that the angle a at which the strip 185 intersects (imaginary) concentric circles positioned concentrically around the rotational axis A in a plane perpendicular to the rotational axis A is constant. This is shown in FIG. 6*a*.

The strip may cover up to 10% of the total length of the rotor blades when measured from the radial inner end 18 to the radial outer end 17. The remaining portion of the rotor blade, thus between the strip 185 and the radial outer end 17 may be curved. The exact shape of this curved part may be designed to achieve an optimal energy transfer from the rotor blades 15 to the mass that is being pumped, as will be explained in more detail below.

The strip 185 may be given an orientation that is substantial parallel to the flow direction of the mass being pumped. This has the advantage that the radial inner ends 18 of the rotor blades and the strip 185 transfer no or relatively little energy to the mass being pumped, thereby reducing the wear of the radial inner ends 18. Furthermore, possible wear of the radial inner ends 18 has only little effect on the characteristics of the centrifugal pump 1.

The direction of movement of the mass near the radial inner ends 18 may depend on the characteristics of the centrifugal pump 1 and on the operational parameters (revolutions per minute, type of mass to be pumped, etc.). Therefore, the direction of the strip 185 may be determined by the direction of movement of the mass when the centrifugal pump is operated at the best efficiency point (BEP), which is the flow at which the efficiency of the pump is highest. This parameter is known to the skilled person for a specific centrifugal pump.

As mentioned above, the shape of the rotor blades 15 in between the radial inner end 18 and the radial outer end 17 may be designed to optimize the energy transfer from the rotor blades 15 to the mass being pumped. According to an advantageous embodiment depicted in FIG. 7*a*, wherein at least part of the rotor blade adjacent the suction shield 12 comprises

- a first part 187 in which the radius ($R_{12}$) of the rotor blade 15 with respect to the axial rotation axis A increases at a first rate as a function of the angle $\phi p$,
- a second part 188 in which the radius ($R_{12}$) of the rotor blade 15 with respect to the axial rotation axis A increases at a second rate as a function of the angle $\phi$, and
- a third part 189 in which the radius ($R_{12}$) of the rotor blade 15 with respect to the axial rotation axis A increases at a third rate as a function of the angle $\phi$, wherein the second rate is greater than the first and third rate.

Accordingly, also provided is a double bent rotor blade formed as such.

$R_{12}$ refers to the radius near the suction shield 12.

Figure 7A:
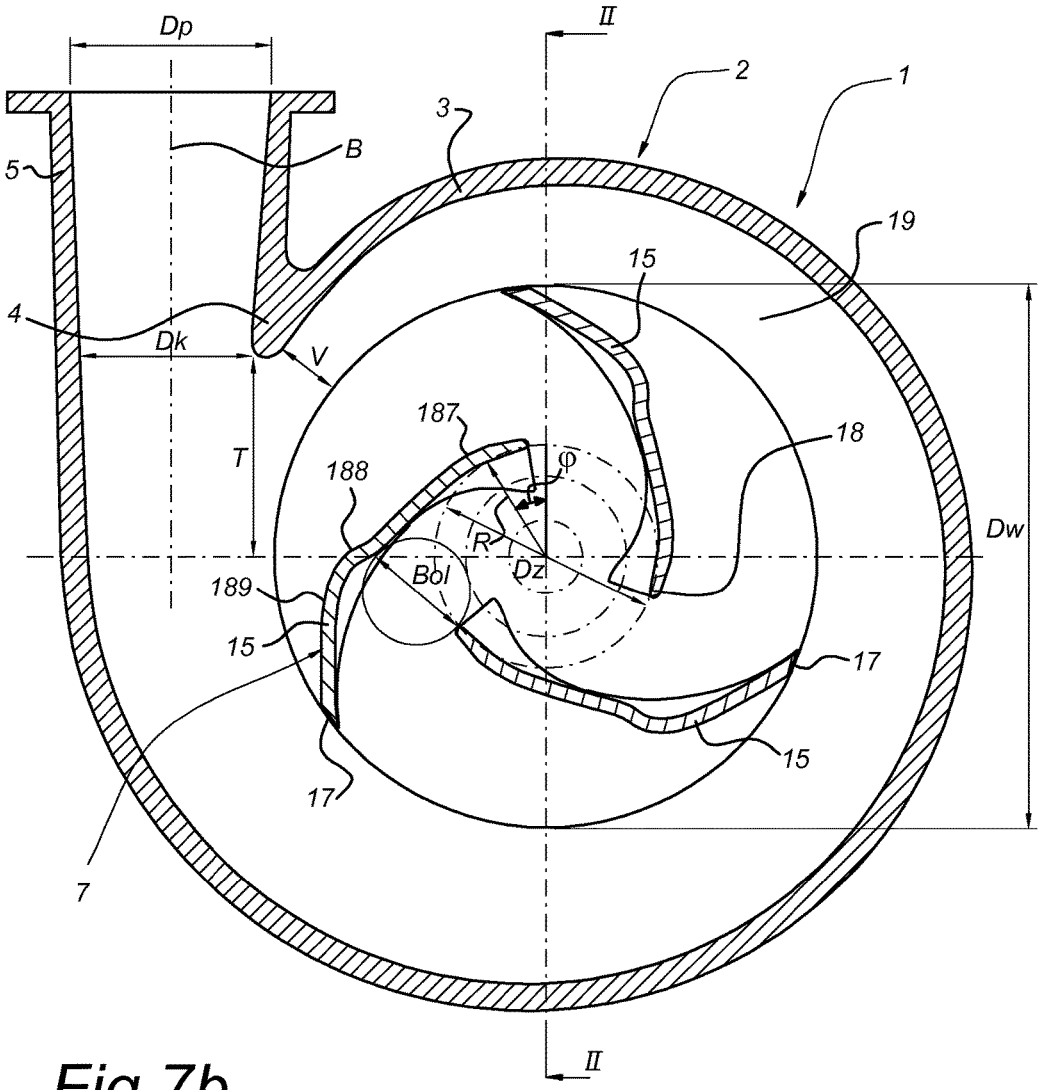

Radius $R_{12}$ is a function of $\phi$. Angle $\phi$ is indicated in FIG. 7*a* and is defined in a plane substantially perpendicular with respect to the axial rotation axis A (perpendicular to the plane of drawing in FIG. 7*a*). Radius R and angle $\phi$ together thus form polar coordinates, with respect to the axial rotation axis A.

Figure 7B:
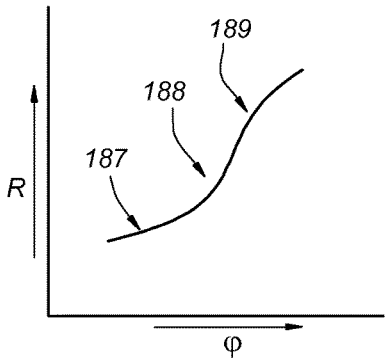

The derivate $DR_{12}/d\phi>0$, while $d^2R_{12}/d\phi^2>0$ at the transition between the first part 187 to the second part 188 and $d^2R_{12}/d\phi^2<0$ at the transition between the second part 188 to the third part 189. FIG. 7*b* schematically depicts a graph of $R_{12}$ as a function of $\phi$.

The second rate for instance may at least locally be 1.5 times as high as the first and third rate.

As can be seen in FIG. 7*a*, the second part 188 faces the radial inner end 18 of the next rotor blade 15, thereby providing an increased spherical passage Bol.

The radius R increases continually as a function of $\phi$, both indicated in FIG. 7*a*. the increase is relatively low in the first part 187. In use, the direction of the first part 187 of the rotor blade 15 is parallel to the direction of the flow. The first part 187 therefore transfers no or relatively little energy to the flow.

In the second part 188, the radius R increases relatively strong as a function of $\phi$ to provide a relatively large spherical passage Bol.

It has to be noted that this shape is provided along the edge of the rotor blades 15 adjacent to the suction shield 12. As the rotor blade 15 is double bent the part of the rotor blades 15 adjacent the shaft shield 11 may have a radius $R_{11}$ which increases as a function of $\phi$, the amount of increase decreasing as a function of $\phi$. In other words: $dR_{11}/d\phi>0$, while $d^2R_{11}/d\phi^2<0$. $R_{11}$ refers to the radius near the shaft shield 11*a*.

This embodiment may be combined with the embodiment of the non-curved strip 185 along the radial inner end 18. According to such an embodiment, the rotor blades 15 comprise (in a direction from radial inner end to radial outer end) a non-curved strip 185, a concave first part 188 and a convex second part 189.

The embodiments described with reference to FIGS. 6 and 7*a*-*b* may also be combined with the other embodiments as described, such as the embodiments described with reference to FIGS. 5*a*-5*b*.

According to a further embodiment the rotor blades 15 comprise a thickened strip 186 along the radial inner ends 18, the thickened strips 186 being substantially thickened in a direction perpendicular to the surface of the rotor blades 15.

Figure 8:
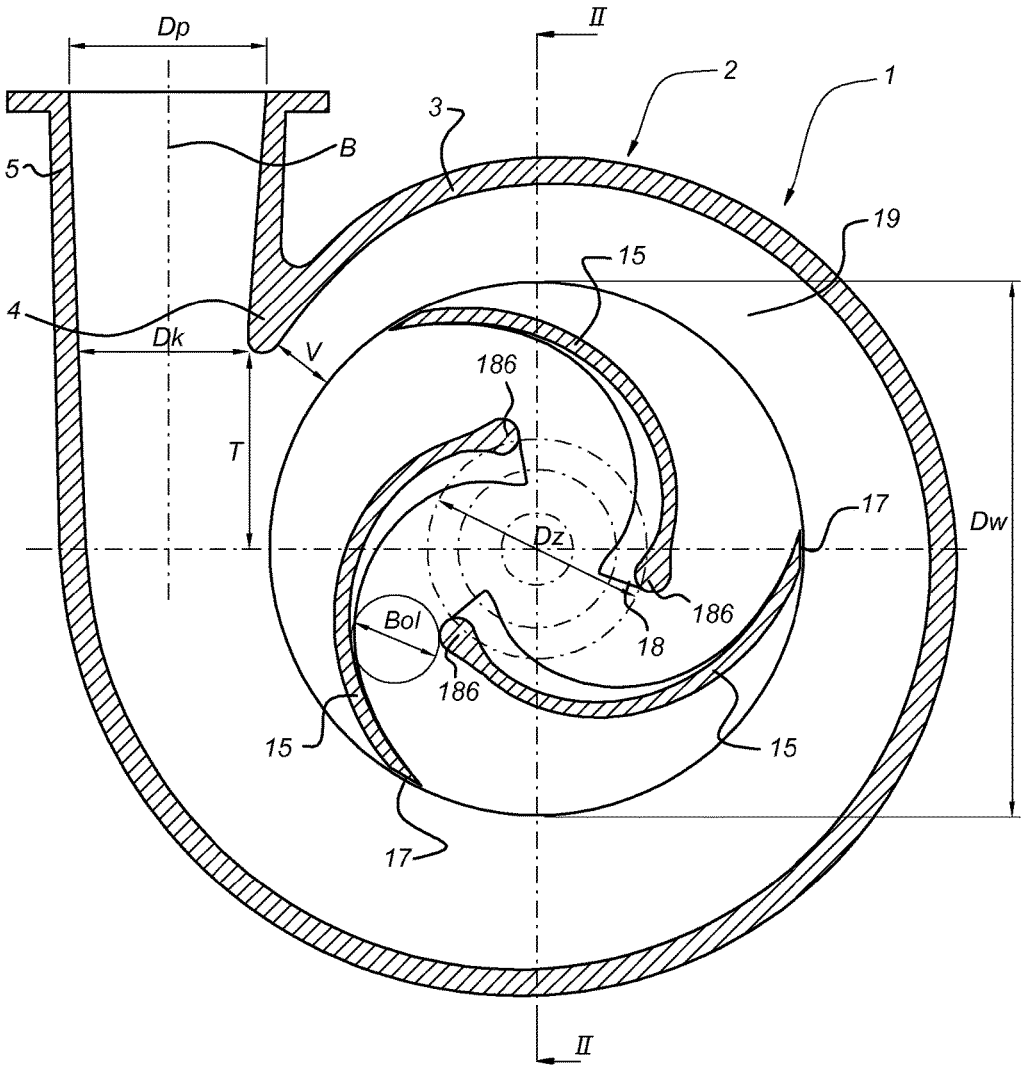

FIG. 8 schematically depicts a centrifugal pump with three rotor blades 15 each comprising a thickened strip 186 that extends along at least part of the radial inner ends 18. The thickening may extend to both sides of the rotor blades 15, i.e. on an inner side of the rotor blade 15 facing the rotation axis A and on an outer side of the rotor blade 15 facing away from the rotation axis A, as is shown in FIG. 8.

Providing a thickening on the inside and/or outside of the rotor blade 15 has the advantage that the shape of the rotor blades 15 better match the flow lines of the mass being pumped.

Flow separation mainly occurs on the outside of the rotor blade 15 and will most likely occur near the inner radial ends 18. This has a negative effect on the suction capacity of the centrifugal pump. It also may result in cavitation and subsequent wear of the centrifugal pump. By providing a thickening on the outside of the rotor blade 15, flow separation is reduced. Thus, according to an embodiment, the thickening may be provided on the outside of the rotor blade 15 (i.e. the side of the rotor blade 15 facing away from the axial rotation axis A), thereby preventing or at least reducing flow separation.

Figure 9A:
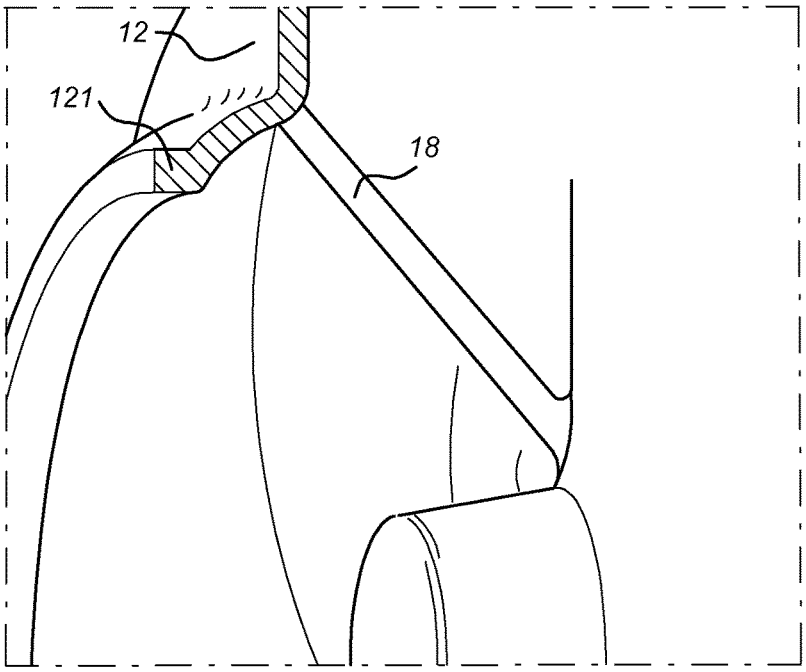
Figure 9B:
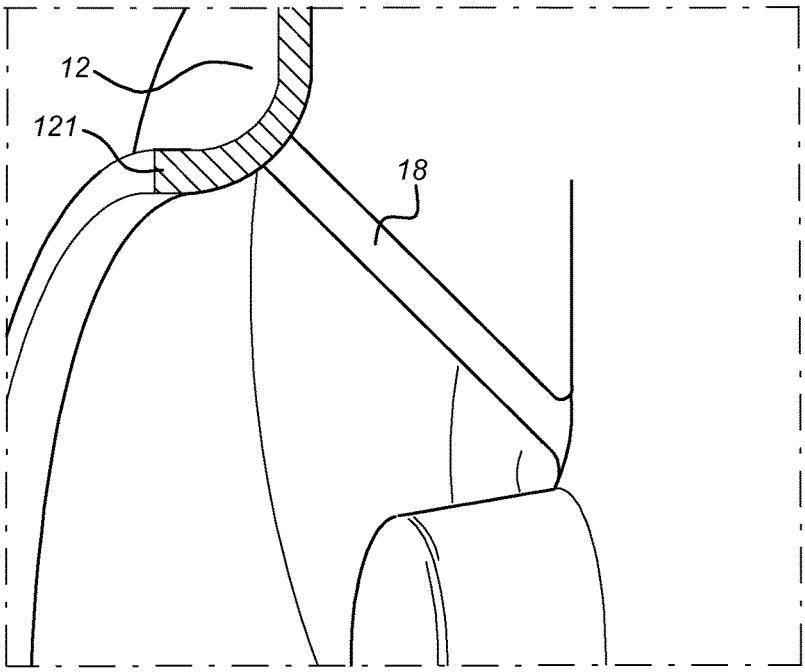

By providing a thickening on the inside and/or on the outside of the rotor blade 15, the rotor blade 15 is strengthened and comprises more material, so allowing the rotor blade 15 to withstand wear for a longer operation time. FIGS. 9*a* and 9*b* show further embodiments of the centrifugal pump, wherein the suction shield 12 comprises an inner edge 121 defining the axial supply 14 of the rotor 7 having a suction diameter Dz (similar to FIG. 2) and wherein the radial inner ends 18 of the rotor blades 15 connect to the suction shield 12 on a location of the suction shield 12 away from the inner edge 121 having a diameter that is larger than the suction diameter Dz. The inner edge 121 is formed as a nozzle arranged to receive the mass to be pumped. In between the inner edge 121 and the remainder of the suction shield 12 is a bend to which the radial inner ends 18 are connected.

By providing rotor blades 15 that are pulled inward the flow area of the axial supply 14 is somewhat increased as it no longer comprises rotor blades. As a result, the local flow velocity will be reduced, reducing (the risk of) cavitation and the suction characteristics will be improved. Also, by providing rotor blades 15 which are connected to the suction shield 12 at a location away from the inner edge 121, it is relatively easy to a right angle between the radial inner ends 18 and the suction shield 12.

FIG. 9*a* shows an embodiment with a similar suction shield 12 as depicted in the embodiments described above and in FIGS. 1-3. FIG. 9*b* shows a suction shield 12 which is curved differently. In use, a medium enters the rotor 7, the rotor 7 providing kinetic energy to the medium, which is later transferred into static pressure. The embodiments provided above provide improved suction characteristics, which mainly relate to the suction characteristics.

The centrifugal pump according to the embodiments has improved characteristics, especially with regard to the efficiency, the suction characteristics and wear. The centrifugal pump may be used in all kind of situations, including situations with a relatively high or low hydrostatic inlet pressure.

The descriptions above are intended to be illustrative, not limiting. Thus, it will be apparent to one skilled in the art that modifications may be made to the invention as described without departing from the scope of the claims set out below.

The invention claimed is:

1. A centrifugal pump, in particular for the pumping of a mixture of substances possibly including soil, comprising:

a pump housing which is provided with an axial inlet and an outlet attached tangentially to a circumferential wall of the pump housing, a rotor which is attached in the pump housing such that it can rotate about an axial rotation axis A, which rotor is provided with a central boss, a shaft shield fastened to the boss, a suction shield attached so as to be axially set apart from the shaft shield, which suction shield has an axial supply aligned with the axial inlet of the pump housing, and a plurality of double bent rotor blades which are fastened between the shields and each extend transversely to the rotation axis A between a radial outer end and a radial inner end, characterized in that the radial inner ends forming a right angle with respect to the suction shield, wherein the radial inner ends of the rotor blades extending between the shaft shield and the suction shield have a S-curved shape comprising a first part and a second part, and wherein the second part of the rotor blades near the shaft shield is in a first upright direction, and the first part of the rotor blades is towards the suction shield in a direction such that the connection between the first part of the rotor blades and the suction shield is perpendicular, and wherein the blades are curved in a first direction from the radial inner ends to the radial outer ends and are curved in a second direction perpendicular to the first direction.

2. The centrifugal pump according to claim 1, wherein the rotor blades comprise a strip along the radial inner ends that is shaped such that in a direction perpendicular to the respective radial inner end the radius (R) of the rotor blade is a function of an angle $\phi$ with respect to the rotation axis $A:R(\phi)=C_1\cdot\phi+C_2$, wherein $C_1$ and $C_2$ are constants.

3. The centrifugal pump according to claim 1, wherein at least part of the rotor blade adjacent the suction shield comprises a first part in which the radius of the rotor blade with respect to the axial rotation axis (A) increases at a first rate as a function of the angle ($\phi$), a second part in which the radius of the rotor blade with respect to the axial rotation axis (A) increases at a second rate as a function of the angle ($\phi$), and a third part in which the radius of the rotor blade with respect to the axial rotation axis (A) increases at a third rate as a function of the angle ($\phi$), wherein the second rate is greater than the first and third rate.

4. The centrifugal pump according to claim 1, wherein the rotor blades comprise a thickened strip along the radial inner ends, the thickened strips being thickened in a direction perpendicular to the surface of the rotor blades.

5. The centrifugal pump according to claim 1, wherein the suction shield comprises an inner edge defining the axial supply of the rotor having a suction diameter (Dz) and wherein the radial inner ends of the rotor blades connect to the suction shield on a location of the suction shield away from the inner edge having a diameter that is larger than the suction diameter (Dz).

6. A double bent rotor blade for use in a centrifugal pump, in particular for the pumping of a mixture of substances possibly including soil, the rotor blade comprising a radial inner end and a radial outer end, the rotor blade being arranged to be mounted on a mounting position between a shaft shield and a suction shield in a centrifugal pump, the radial inner end being formed such that in the mounting position it forms a right angle with respect to the suction shield, wherein the radial inner end has a S-curved shape, which comprises a first part which in the mounting position is near the suction shield, the first part being towards the suction shield in a direction such that the connection between the first part of the rotor blade and the suction shield is perpendicular, the second part being in a first upright direction, and wherein the blade is curved in a first direction from the radial inner end to the radial outer end and is curved in a second direction perpendicular to the first direction.

7. The double bent rotor blade according to claim 6, wherein the rotor blade-comprises a strip along the radial inner end that is shaped such that in a direction perpendicular to the respective radial inner end the radius (R) of the rotor blade is a function of an angle $\phi$ with respect to the rotation axis $A:R(\phi)=C_1\cdot\phi+C_2$, wherein $C_1$ and $C_2$ are constants.

8. The double bent rotor blade according to claim 6, wherein at least part of the rotor blade that is adjacent to the suction shield in the mounting position comprises a first part in which the radius ($R_{12}$) of the rotor blade with respect to the axial rotation axis (A) increases at a first rate as a function of angle ($\phi$), a second part in which the radius ($R_{12}$) of the rotor blade with respect to the axial rotation axis (A) increases at a second rate as a function of the angle ($\phi$), and a third part in which the radius ($R_{12}$) of the rotor blade with respect to the axial rotation axis (A) increases at a third rate as a function of the angle ($\phi$), wherein the second rate is greater than the first and third rate.

9. The double bent rotor blade according to claim 6, wherein the rotor blade comprises a thickened strip along the radial inner end, the thickened strip being thickened in a direction perpendicular to the surface of the rotor blade.

10. The double bent rotor blade according to claim 6, wherein the radial inner end of the rotor blade is shaped such that after mounting, the radial inner end connects to the suction shield on a location of the suction shield away from an inner edge of the suction shield, having a diameter that is larger than the suction diameter (Dz).

11. A vessel, comprising a centrifugal pump according to claim 1.

12. The centrifugal pump according to claim 1, wherein the first parts near the suction shields are convex towards the axial supply and the second parts near the shaft shields are concave towards the axial supply.

13. The double bent rotor blade according to claim 6, wherein the first part near the suction shield is convex towards the axial supply and the second part near the shaft shield is concave towards the axial supply.

* * * * *